US006421447B1

(12) United States Patent
Chu

(10) Patent No.: US 6,421,447 B1
(45) Date of Patent: Jul. 16, 2002

(54) METHOD OF GENERATING SURROUND SOUND WITH CHANNELS PROCESSING SEPARATELY

(75) Inventor: Yu-Ming Chu, Taipei (TW)

(73) Assignee: Inno-Tech Co., Ltd., Taipei (TW)

( * ) Notice: Subject to any disclaimer, the term of this patent is extended or adjusted under 35 U.S.C. 154(b) by 0 days.

(21) Appl. No.: 09/408,942

(22) Filed: Sep. 30, 1999

(51) Int. Cl.[7] ..... H04R 5/00
(52) U.S. Cl. ..... 381/18; 381/19; 381/28
(58) Field of Search ..... 381/1, 17, 18, 381/19, 28

(56) References Cited

U.S. PATENT DOCUMENTS 3,725,586 A * 4/1973 Iida ..... 381/18
4,121,059 A * 10/1978 Nakabayashi ..... 381/18
5,982,903 A * 11/1999 Kinoshita et al. ..... 381/17

* cited by examiner

*Primary Examiner*—Minsun Oh Harvey
(74) *Attorney, Agent, or Firm*—Leong C. Lei

(57) ABSTRACT

A method of generating surround sound with channels processing separately includes steps of transmitting left and right channel signals separately to a first multiple frequency phase shift processor, a pre-set equalizer and a second multiple frequency phase shift processor without addition and subtraction thereby providing a stereo sound position enhancement processing, transmitting left and right space signals separately to two multiple frequency phase shift processors, two stereo signal difference processors and a pre-set equalizer to provide a surround sound enhancement processing, and transmitting left channel signals, left space signals, right channel signals and right space signals separately to respective variable amplifiers to adjust output amplitude after the sound position enhancement processing and the surround sound enhancement processing and then summing up output signals to obtain three dimensional effect enhancement.

5 Claims, 3 Drawing Sheets

METHOD OF GENERATING SURROUND SOUND WITH CHANNELS PROCESSING SEPARATELY

BACKGROUND OF THE INVENTION

1. Field of the Invention

This invention is related to a method of generating surround sound with channels processing separately and in particular to one which can enhance the left and right channels of a stereo system to provide a simulated three dimensional effect.

2. Description of the Prior Art

The conventional way of enhancing a conventional stereo system to provide a three dimensional effect must be achieved by professionals thereby making it too expensive to afford for ordinary people and therefore rendering it difficult to promote widely.

Therefore, it is an object of the present invention to provide an improved method of generating surround sound with channels processing separately which can obviate and mitigate the above-mentioned drawbacks.

SUMMARY OF THE INVENTION

This invention is related to a method of generating surround sound with channels processing separately and in particular to one which can provide a three dimensional effect enhancement from the left and right channels of a stereo sound system.

It is the primary object of the present invention to provide a method of generating surround sound with channels processing separately includes steps of transmitting left and right channel signals separately to a first multiple frequency phase shift processor, a pre-set equalizer and a second multiple frequency phase shift processor without addition and subtraction thereby providing a stereo sound position enhancement processing, transmitting left and right space signals separately to two multiple frequency phase shift processors, two stereo signal difference processors and a pre-set equalizer to provide a surround sound enhancement processing, and transmitting left channel signals, left space signals, right channel signals and right space signals separately to respective variable amplifiers to adjust output amplitude after the sound position enhancement processing and the surround sound enhancement processing and then summing up output signals to obtain three dimensional effect enhancement.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which apreferred structural embodiment incorporating the principles of the present invention is shown by way of illustrative example.

DETAILED DESCRIPTION OF THE PREFERRED EMBODIMENT

Figure 1:
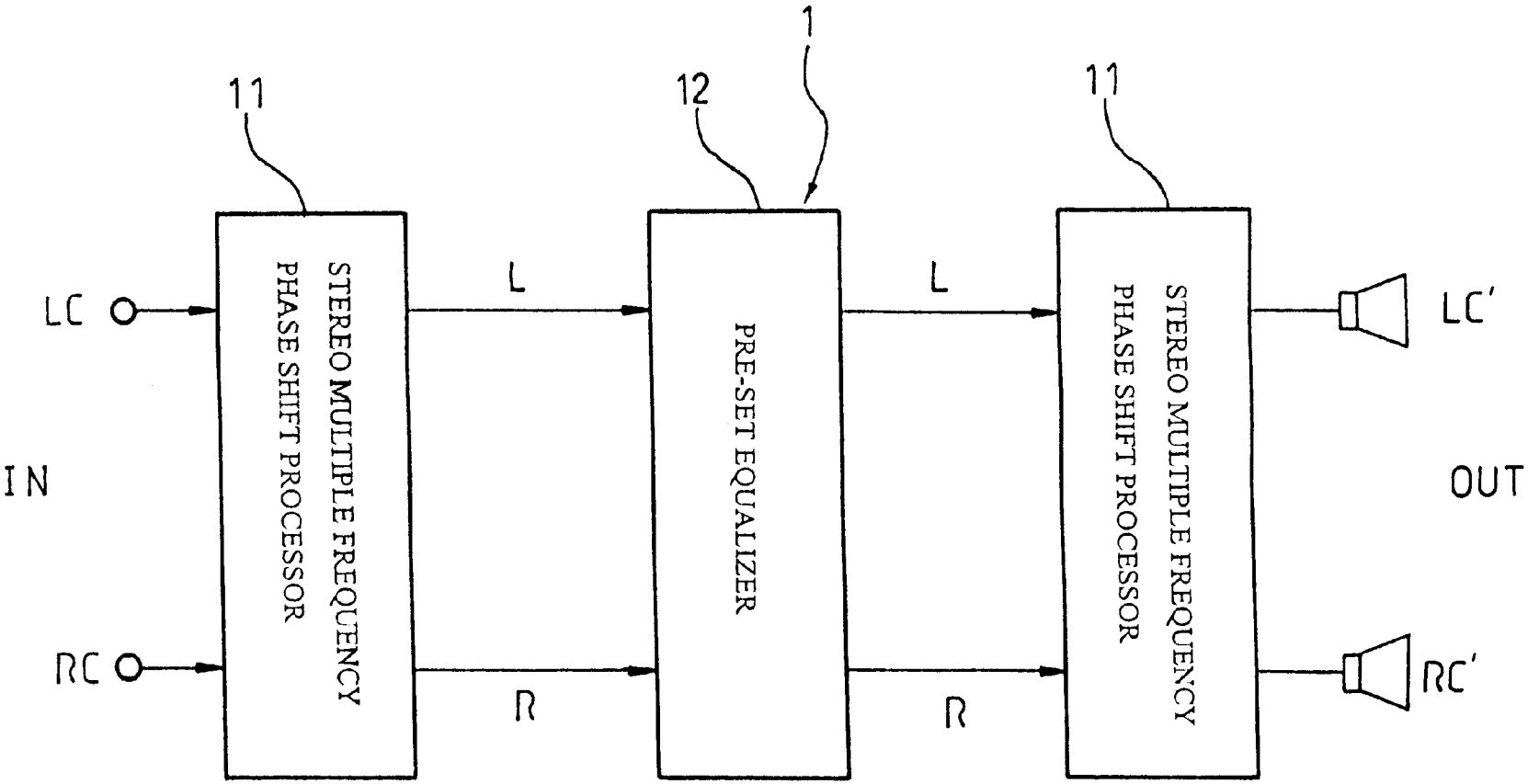
FIG. 1 is a block diagram of the stereo sound posifion enhancement processing system according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
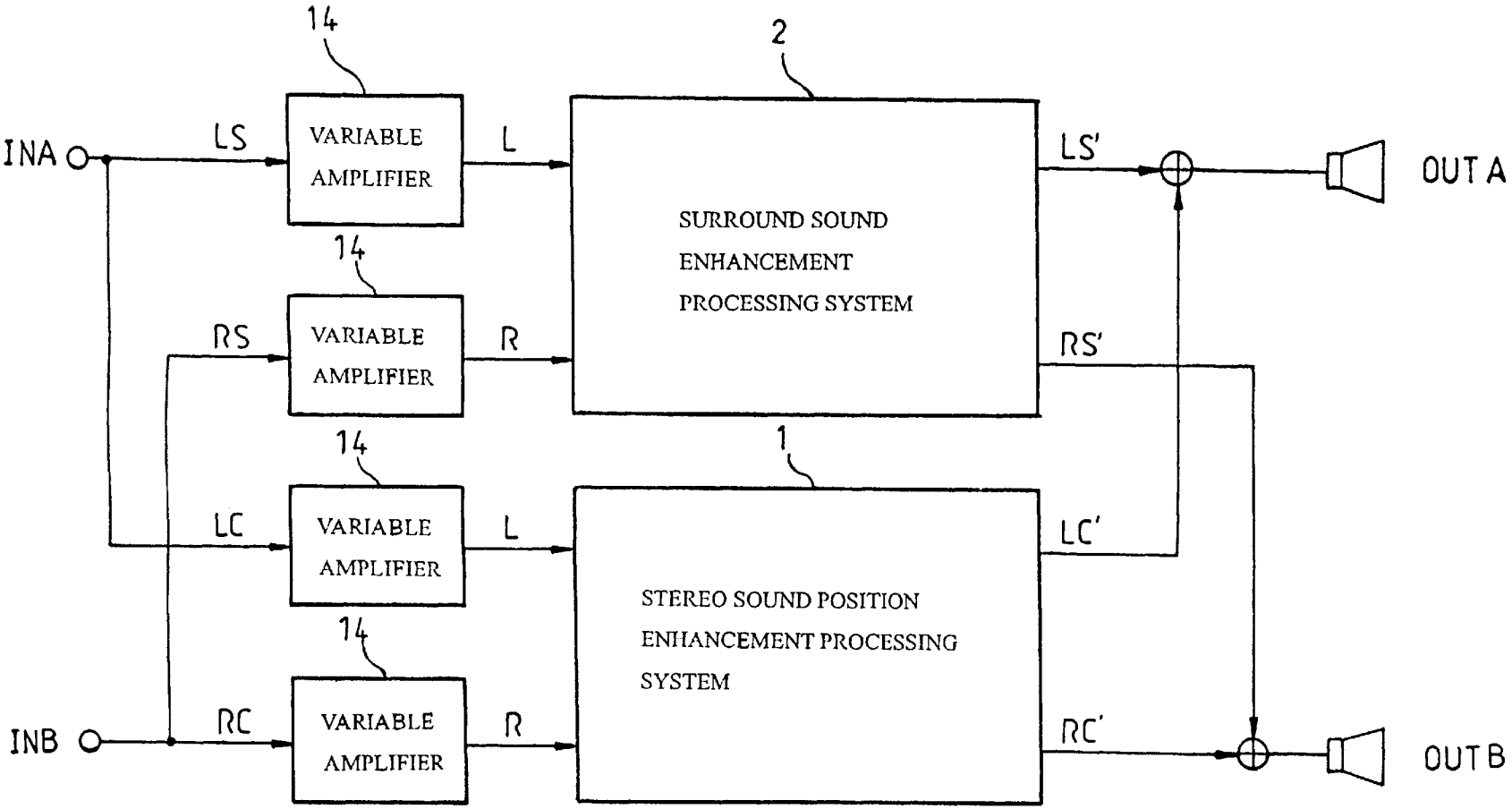
FIG. 3 is ablock diagram of illustrating the method of generating surround sound with channels processing separately.

With reference to the drawings and in particular to FIG. 3, the method of generating surround sound with channels processing separately according to the present invention generally comprises a stereo sound position enhancement processing system 1, a surround sound enhancement processing system 2, and a plurality ofvariable amplifiers 14.

Referring to FIG. 1, the stereo sound position enhancement processing system 1 according to the present invention generally comprises two stereo multiple frequency phase shift processors 11 and a stereo pre-set equalizer 12. The stereo multiple frequency phase shift processor 11 may be used for shifing phase of any frequency within 20 Hz~40 KHz from −180 degrees to +180 degrees. The stereo pre-set equalizer 12 is used for adjusting the amplitude and slope of any frequency within 20 Hz~40 KHz as desired so as to make left channel signals and right channel signals pass through a first stereo multiple frequency phase shift processor 11 and the stereo pre-set equalizer 12 respectively to a second stereo multiple frequency phase shift processor 11. Then, the left channel signals LC and right channel signals RC are defined as LC' and RC' respectively after being processed by the second stereo multiple frequency phase shift processor 11. The LC' and RC' and the aforementioned procedures are not processed with sum or difference treatment, thereby constituting a stereo sound position enhancement processing.

Figure 2:
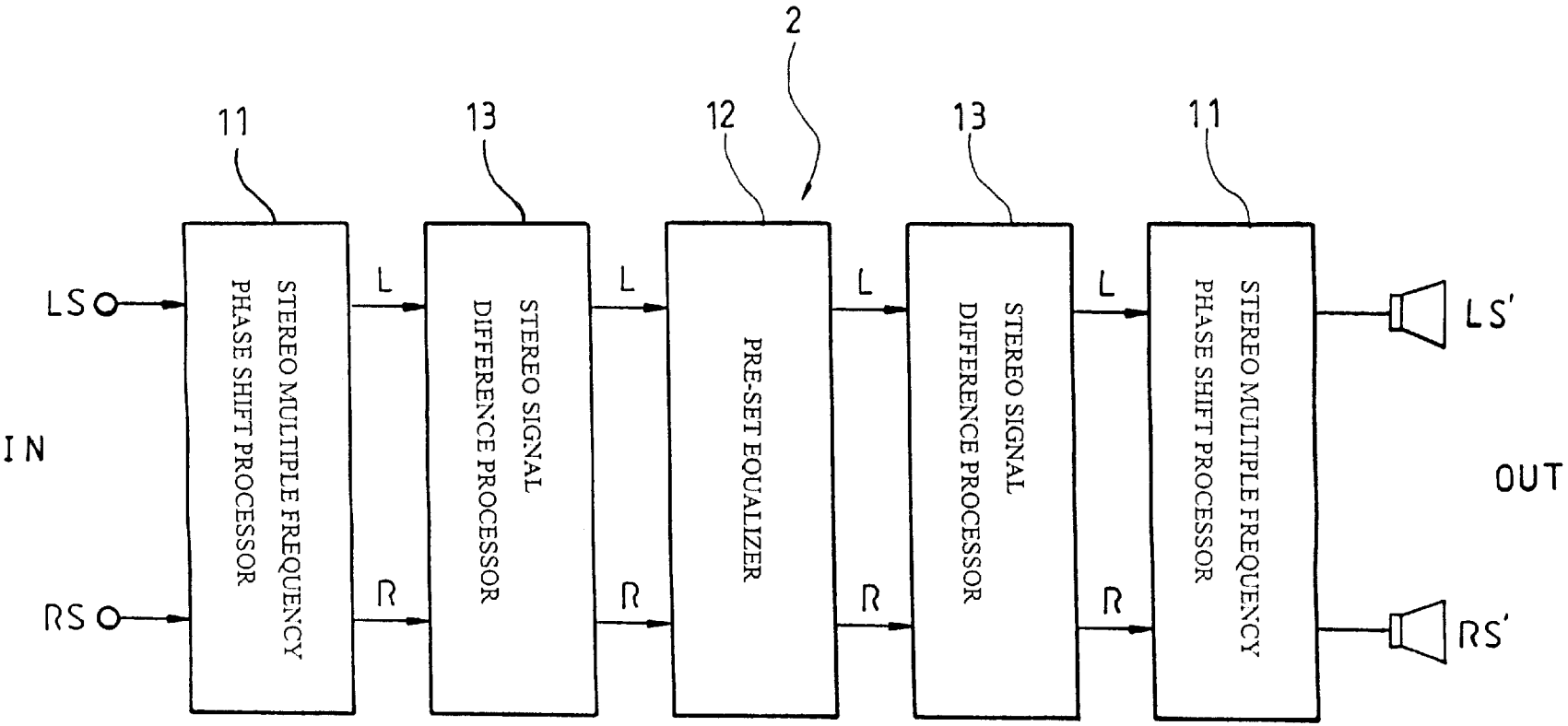
FIG. 2 is a block diagram of the surround sound effect enhancement processing system according to the present invention.

Referring to FIG. 2, the surround sound enhancement processing system 2 includes two stereo multiple frequency phase shift processors 11, a stereo pre-set equalizer 12, and two stereo signal difference processors 13. The first stereo multiple frequency phase shift processor 11 is used for shifting the phase of any frequency of left space and right space signals from −180 degrees to +180 degrees. The first stereo signal difference processor 13 is used for subtracting signal of any amplitude from the left space (LS) from signal of any amplitude from the right space (RS), so that the degree of subtraction is adjustable. In the meantime, the signals from LS and RS are maintained as separate stereo signals. Then, the signals are separately input into the pre-set equalizer 12 in which the amplitude and slope of any frequency within 20–40 KHz can be adjusted as desired. Thereafter, the signals are transmitted to a second stereo signal difference processor 13 and then to a second stereo multiple frequency phase shift processor 11. The signals from LS and RS after being processed are defined as LS' and RS' respectively, thereby constituting a surround sound enhancement processing.

Referring to FIG. 3, the signals LS, RS, LC and RC are input into a respective variable amplifier 14 to adjust the amplitude of LC', LS', RL' and RS' to add LC' to LS' and RS' to RC' to provide an eminent 3 dimensional stereo sound enhancement effect.

Furthermore, the phase of the multiple frequency phase shift processor 11 for processing the signals LC and LS differs from the phase of the multiple frequency phase shift processor 11 for processing the signals RC and RS by an angle of at least 90 degrees thereby achieving the purpose of forming a false stereo sound enhancement processing system from a single tone signal. In addition, the adjustment of the phase angle between the multiple frequency phase shift processors of L and R can achieve of adjusting the false stereo sound enhancing degree.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A method of generating surround sound with channels processing separately comprising steps of:

transmitting left and right channel signals separately to a first multiple frequency phase shift processor, a pre-set equalizer and a second multiple frequency phase shift processor without addition and subtraction thereby providing a stereo sound position enhancement processing;

transmitting left and right space signals separately to two multiple frequency phase shift processors, two stereo signal difference processors and a pre-set equalizer to provide a surround sound enhancement processing; and transmitting left channel signals, left space signals, right channel signals and right space signals separately to respective variable amplifiers to adjust output amplitude after said sound position enhancement processing and said surround sound enhancement processing and then summing up output signals to obtain three dimensional effect enhancement.

2. The method of generating surround sound with channels processing separately as claimed in claim 1, wherein said multiple frequency phase shift processor allows phase shift of a frequency within 20~40 KHz from −180 degrees to +180 degrees.

3. The method of generating surround sound with channels processing separately as claimed in claim 1, wherein said pre-set equalizer is used for adjusting amplitude and slope of a frequency within 20 Hz~40 KHz.

4. The method of generating surround sound with channels processing separately as claimed in claim 1, wherein said left channel signals, left space signals, right channel signals and right space signals differ at least 90 degrees in phase to make single tone signal provide a simulated stereo effect processing system.

5. The method of generating surround sound with channels processing separately as claimed in claim 4, wherein said simulated stereo effect processing system utilizes phase difference between multiple frequency phase shift processors to adjust degree of simulated stereo effect.

* * * * *